US010222169B2

(12) United States Patent
Delano et al.

(10) Patent No.: US 10,222,169 B2
(45) Date of Patent: Mar. 5, 2019

(54) CONFETTI LAUNCHER

(71) Applicant: Roneé Holmes, Palm Harbor, FL (US)

(72) Inventors: Mark Delano, Pinellas Park, FL (US); Scott Fletcher, Clearwater, FL (US)

(73) Assignee: Roneé Holmes, Palm Harbor, FL (US)

( * ) Notice: Subject to any disclaimer, the term of this patent is extended or adjusted under 35 U.S.C. 154(b) by 0 days.

(21) Appl. No.: 15/583,520

(22) Filed: May 1, 2017

(65) Prior Publication Data

US 2018/0313632 A1 Nov. 1, 2018

(51) Int. Cl.

| | |
|---|---|
| ***F41B 11/89*** | (2013.01) |
| ***F41B 11/723*** | (2013.01) |
| ***F41B 11/62*** | (2013.01) |
| ***A63H 37/00*** | (2006.01) |

(52) U.S. Cl.

CPC ..... *F41B 11/89* (2013.01); *A63H 37/00* (2013.01); *F41B 11/62* (2013.01); *F41B 11/723* (2013.01)

(58) Field of Classification Search

CPC ..... F41B 11/89; F41B 11/62; F41B 11/723; A63H 37/00

USPC ..... 124/71, 73, 74

See application file for complete search history.

(56) References Cited

U.S. PATENT DOCUMENTS

| | | | | |
|---|---|---|---|---|
| 825,843 | A | 7/1906 | Kliemandt | |
| 1,153,207 | A | 9/1915 | Eisenberg | |
| 1,491,809 | A | 4/1924 | Macchia | |
| 1,663,679 | A | 3/1928 | Carpenter | |
| 2,375,314 | A * | 5/1945 | Mills | F41B 11/62 124/40 |
| 2,756,737 | A | 7/1956 | Resch, Jr. | |
| 3,680,540 | A * | 8/1972 | Stengl | F41B 11/62 124/50 |
| 3,999,750 | A | 12/1976 | Perkins | |
| 5,015,211 | A | 5/1991 | Raveen | |
| 5,149,290 | A | 9/1992 | Raveen | |
| 5,338,242 | A | 8/1994 | Cheng | |
| 5,352,148 | A | 10/1994 | Watkins | |
| 5,403,225 | A | 4/1995 | Watkins | |

(Continued)

*Primary Examiner* — Joshua E Freeman

(74) *Attorney, Agent, or Firm* — Kolisch Hartwell, P.C.

(57) ABSTRACT

A launching system for launching light weight articles into air comprising an elongated hollow tube or cannon filled with at least one light weight article such as confetti, a female quick disconnect member, a ball valve, a male extrusion, a reservoir and a source of compressed gas. The female quick disconnect member having at least one cam lock lever at proximal end facilitates quick connection and disconnection of the elongated hollow tube and the distal end of the female quick disconnect member is connected to one end of the ball valve via a male extrusion, further the ball valve having one handle which acts as a trigger. Further top end of the reservoir is connected to other end of the ball valve and a source of compressed gas such as compressed CO2 gas cartridge which is connected to bottom end of the reservoir, wherein the source supplies compressed gas that is stored in the reservoir until the trigger of the ball valve is turned to open position allowing the compressed gas to escape from the reservoir into the elongated hollow tube, thereby launching the light weight articles into the air. The device provides single shot or multiple shots of confetti from the cannon with a single cartridge in a more safe and controlled manner.

9 Claims, 3 Drawing Sheets

(56) References Cited

U.S. PATENT DOCUMENTS 5,413,731 A 5/1995 Alder et al.
5,496,025 A * 3/1996 Phillips ..... A63B 69/409 124/56
5,507,680 A 4/1996 Watkins
5,531,628 A 7/1996 Watkins
5,532,618 A 7/1996 Hardee et al.
5,538,454 A 7/1996 Kessler
5,556,319 A 9/1996 Watkins
5,624,295 A 4/1997 Watkins
5,634,840 A * 6/1997 Watkins ..... A63H 37/00 446/475
5,643,042 A 7/1997 Watkins
5,655,325 A 8/1997 Watkins
5,709,584 A 1/1998 Watkins
5,772,491 A * 6/1998 Watkins ..... A63H 37/00 446/475
5,823,850 A 10/1998 Watkins
6,149,495 A 11/2000 Austin et al.
6,273,080 B1 * 8/2001 Sullivan, Jr. ..... F41B 11/00 124/73
6,290,267 B1 * 9/2001 Swingley ..... F16L 37/18 137/614.06
6,295,752 B1 * 10/2001 Havlock ..... F41A 21/00 124/71
6,364,737 B1 * 4/2002 Sterr ..... A63H 37/00 124/74
6,641,458 B1 * 11/2003 Nofsinger ..... A63H 37/00 124/74
6,749,481 B1 * 6/2004 Yap ..... A63H 5/04 124/74
7,076,905 B2 * 7/2006 Zouboulakis ..... F41A 11/02 124/83
8,469,768 B1 6/2013 Smith
8,951,094 B2 * 2/2015 Ropelewski ..... A63H 37/00 446/475
2002/0083937 A1 * 7/2002 Fu ..... A63H 37/00 124/57
2003/0024956 A1 2/2003 Crawford
2003/0069091 A1 * 4/2003 Wengert ..... A63B 69/36 473/409
2003/0143922 A1 * 7/2003 Du ..... A63H 37/00 446/475
2005/0066953 A1 * 3/2005 Zouboulakis ..... F41A 11/02 124/73
2006/0199469 A1 9/2006 Du
2006/0283433 A1 * 12/2006 Gerardo ..... F41B 11/62 124/74
2007/0131209 A1 * 6/2007 Campo ..... F41B 11/57 124/56
2009/0194974 A1 * 8/2009 Smith ..... A61G 5/02 280/647
2010/0048049 A1 * 2/2010 Du Plessis ..... H01R 13/22 439/157
2010/0192930 A1 * 8/2010 Lammonds ..... F41B 11/62 124/74
2015/0034062 A1 * 2/2015 Willett ..... F41B 11/71 124/77
2015/0316345 A1 * 11/2015 Brahler, II ..... F41B 11/72 124/73
2015/0352460 A1 12/2015 Holmes
2015/0359920 A1 12/2015 Ohtsuka et al.
2015/0360140 A1 * 12/2015 Hillery ..... A63H 37/00 446/475
2016/0146567 A1 * 5/2016 Nachefski ..... F41B 11/721 124/73
2016/0175731 A1 6/2016 Holmes
2018/0025345 A1 * 1/2018 Kittoe ..... G06Q 20/341

* cited by examiner

CONFETTI LAUNCHER

FIELD OF THE INVENTION

The present invention relates generally to a system and method for launching light weight articles into air and more particularly it relates to a system and method for launching confetti into air in a controlled manner by using compressed gas cylinders such as compressed $CO_2$ gas cartridge.

BACKGROUND OF THE INVENTION

The use of so-called "cannons" by a user to shoot confetti at amusement parks, concerts, and other events has long been enthusiastically enjoyed by audiences. Such cannons are powered by compressed gas tanks, or compressed gas cylinders, which operate at pressures in the order of 600-800 p.s.i., and the cannons are usually in the order of several feet long, with a wall thickness in the order of ¼ inch and composed of PVC or metal tubing. Accordingly, such systems are expensive, bulky and are not safe in the hands of non-professional users. In addition, cannons which are designed for use with CO2 cartridges, such as those disclosed in U.S. Pat. Nos. 2,756,737 and 5,149,290 operate on the basis of puncturing the seal on the compressed gas cartridge such as CO2 cartridge such that the entire cartridge is suddenly emptied of the high pressure gas in one, uncontrolled and uncontrollable discharge. Such operation not only has obvious safety hazards, but it is also expensive in that each CO2 cartridge can only provide one shot of confetti from the cannon. Thus, it is not possible to shoot a plurality of small loads of confetti with a single cartridge as is desirable for the user on stage or at relatively small parties and other festive occasions like shows, parties like birthday, wedding, Christmas and New Year's Eve, stage shows, rock concerts, conventions, parades, circus acts and other events so as to produce displays of sound, color and motion. These lightweight materials, in general, create an atmosphere of festivities and excitement for partygoers and/or spectators. Common examples of these lightweight materials include confetti, streamers, glitters, plush balls, foam shapes, etc. Confetti is often created from paper or polyvinyl film that is cut into different shapes, styles, and sizes. Confetti can also be made in a variety of different colors and shapes. Streamers are long strips of paper or polyvinyl film that are curled up into rolls. As by the confetti and/or the streamers are projected into the air, they scatter and fall creating a pleasing visual effect.

At small events, these lightweight materials can be projected by hand or a handheld device. But at larger events, particularly those that are held in wide areas, a specialized projector may be required. The projector such as a confetti cannon often makes use of an ejection member forming the barrel of the cannon. At the base of the barrel is a force supplying apparatus such as a motorized fan, gun-powder-explosive system, or compressed air from a pressurized canister.

Bursts of confetti and/or streamers shot out of the cannons connected to compressed gas sources have long been used, but in an uncontrolled manner. In addition to these cost and environmental factors, prior cannons have been designed so as to remain connected to the compressed gas source; such sources being in the form of a compressed air line, tank or cylinder, or a CO2 cartridge. That is, the systems have been designed with the closed ends of the cannons bolted or otherwise relatively permanently connected to the compressed gas source, and the cannons are re-used by refilling them with confetti and/or streamers after each use. This presents a serious problem when the cannons are mounted in the rafters or other structures near the ceiling of a theater, hotel ballroom, auditorium or the like where it is difficult to reach them and reload them. This is particularly true with conventional confetti which is difficult and time-consuming to pack and "fluff" into the cannons. As a result, such reloading operations are very slow, labor-intensive and costly operations, particularly when repeatedly shooting half a dozen or more cannons at each of eight or more shows each day. In that situation, there is the further problem that there may not be sufficient time between shows to reload more than several cannons. Thus, the number of cannons which can be used at each show is sometimes limited by the time required for refilling the cannons. In addition, with the use of conventional confetti, it is impossible to predetermine the size or shape of the cloud of confetti produced each time because the compacting and fluffing procedures cannot be held constant.

Thus there is a need for a launching device which provides multiple shots of confetti from the cannon with a single cartridge, however the device can be used as a single shot trigger with a smaller size cartridge, further the device is simple yet easy to manually shoot confetti in a controlled manner and the device having provisions for easy and quick loading and unloading of an elongated hollow tube such as cannons.

Numerous innovations for launching devices have been provided in the prior art as described above. Even though these innovations may be suitable for the specific purposes to which they address, however, they differ from the present invention.

It is apparent now that numerous innovations for confetti launching devices have been provided in the prior art that are adequate for various purposes. Furthermore, even though these innovations may be suitable for the specific purposes to which they address, accordingly, they would not be suitable for the purposes of the present invention as heretofore described. Thus a simple yet capable of executing single shot as well as multiple shots of confetti from the cannon with a single cartridge in a controlled manner is needed. Further inexpensive, portable and simple design of the present invention allows a user to operate, control and manage the device effectively. Even to quickly attach and detach the cannons requires no skill and training, thus it is easy to use and safe.

SUMMARY OF THE INVENTION

The present invention discloses about a system and method for launching light weight articles into air and more particularly it relates to a system and method for launching confetti into air in a controlled manner by using compressed gas cylinders such as compressed $CO_2$ gas cartridge.

According to the present invention the device comprises a launching system for launching light weight articles into air, comprising an elongated hollow tube, wherein the elongated tube comprising at least one light weight article; a female quick disconnect member having at least one cam lock lever at proximal end of the female quick disconnect member, so as to quickly connect and disconnect the elongated hollow tube; a ball valve having one handle which acts as a trigger, wherein distal end of the female quick disconnect member is connected to one end of the ball valve via a male extrusion; a reservoir, wherein top end of the reservoir is connected to other end of the ball valve; and a source of compressed gas which is connected to bottom end of the reservoir, wherein the source supplies compressed gas that is stored in the reservoir until the trigger of the ball valve is turned to open position allowing the compressed gas to escape from the reservoir into the elongated hollow tube, thereby launching the light weight articles into the air.

It is an object of the present invention is to provide a launching system for launching light weight articles into air, wherein the light weight articles comprise stacks of confetti.

It is another object of the present invention is to provide a launching system for launching light weight articles into air, wherein lifting the cam lock lever of the female quick disconnect member quickly releases the elongated hollow tube.

It is another object of the present invention is to provide a launching system for launching light weight articles into air, wherein the outer diameter of the elongated hollow tube provides a snug fit with the inner wall surface of the female quick disconnect member at the proximal end, further, the cam lock lever in closed position provides additional secured connection of the elongated hollow tube.

It is still another object of the present invention is to provide a launching system for launching light weight articles into air, wherein the ball valve is a ¾ inch manually turned quarter-turn valve having a pivoting ball with a hole, thereby allowing flow of compressed gas when the hole is in line with the flow and closed when the ball is pivoted by turning the handle of the ball valve through 90 degrees.

It is still another object of the present invention is to provide a launching system for launching light weight articles into air, wherein the male extrusion is a treaded male extrusion.

It is still another object of the present invention is to provide a launching system for launching light weight articles into air, wherein the reservoir is a cylindrical aluminum pipe of any length. But preferably having length ranging between 4 to 8 inch is commonly used for launching confetti in small parties and other festive occasions, parties like birthday, wedding, Christmas and New Year's Eve, stage shows, rock concerts, conventions, parades, circus acts and other events so as to produce displays of sound, color and motion.

It is still another object of the present invention is to provide a launching system for launching light weight articles into air, wherein the top end of the reservoir is ¾ inch threaded and bottom end is tapered to ⅝ of an inch outer diameter with a ⅜ inch inside thread.

It is still another object of the present invention is to provide a launching system for launching light weight articles into air, wherein the source of compressed gas is a CO2 cartridge which is screwed to the inside thread of the reservoir at the bottom end, wherein a hollow piercing means at the bottom end pierce the cartridge when screwed tightly, thereby allowing the gas to flow into the reservoir.

It is still another object of the present invention is to provide a launching system for launching light weight articles into air, wherein the CO2 cartridge seats against a rubber O ring at the bottom end of the reservoir to make an airtight seal.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
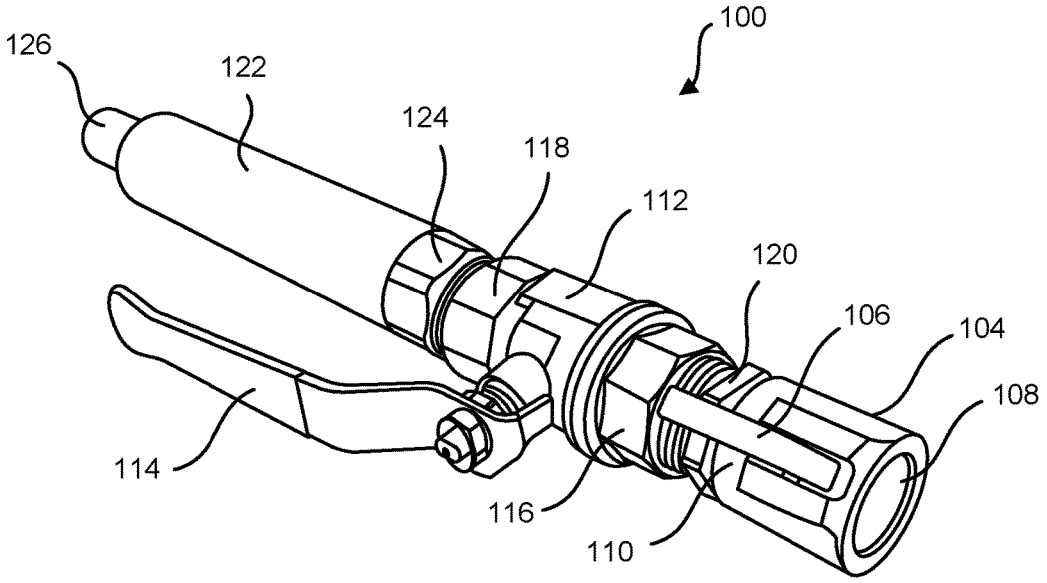
FIG. 1 illustrates a perspective view of an exemplary confetti launching device in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

According to the present invention the device comprises a launching system 100 for launching light weight articles into air is referenced in FIGS. 1-5, wherein the launching system 100 comprising an elongated hollow tube 102, wherein the elongated tube 102 comprising at least one light weight article 103; a female quick disconnect member 104 having at least one cam lock lever 106 at proximal end 108 of the female quick disconnect member 104, so as to quickly connect and disconnect the elongated hollow tube 102; a ball valve 112 having one handle 114 which acts as a trigger, wherein distal end 110 of the female quick disconnect member 104 is connected to one end of the ball valve 112 via a male extrusion 120; a reservoir 122, wherein top end 124 of the reservoir 122 is connected to other end of the ball valve 112; and a source of compressed gas 132 which is connected to bottom end 126 of the reservoir 122, wherein the source 132 supplies compressed gas that is stored in the reservoir 122 until the trigger 114 of the ball valve 112 is turned to open position allowing the compressed gas to escape from the reservoir 122 into the elongated hollow tube 102, thereby launching the light weight articles 103 into the air.

A confetti launching device 100 for launching light weight articles into air as shown in FIG. 1 comprising a female quick disconnect member 104 having one cam lock lever 106 at proximal end 108 of the female quick disconnect member 104, so as to quickly connect and disconnect an elongated hollow tube (not shown); a ball valve 112 having one handle 114 which acts as a trigger, wherein distal end 110 of the female quick disconnect member 104 is connected to one end of the ball valve 112 via a male extrusion 120; a reservoir 122, wherein top end 124 of the reservoir 122 is connected to other end of the ball valve 112; and a source of compressed gas (not shown) which is connected to bottom end 126 of the reservoir 122.

Figure 2:
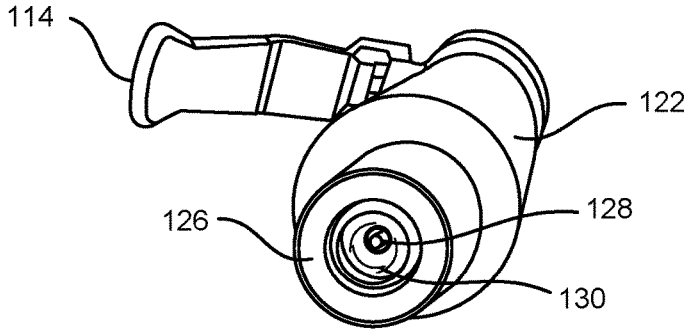
FIG. 2 illustrates a bottom view of the launching device in accordance with an embodiment of the present invention.

FIG. 2 illustrates bottom view of the launching device 100, showing a central hollow piercing means 128 such as a hollow steel shaft at the bottom end 126 of the aluminum pipe 122 which pierce the cartridge (not shown) when screwed tightly and a rubber O ring 130 at the bottom end 126 of the aluminum pipe 122 to make an airtight seal, thus allowing the gas to flow into the aluminum pipe 122 which acts as a reservoir to store the compressed gas until the trigger 114 of the ball valve 112 is turned to open position, thereby allowing the compressed gas to escape from the reservoir 122 into the elongated hollow tube (not shown) to launch the loaded confetti (not shown) into the air.

Figure 3:
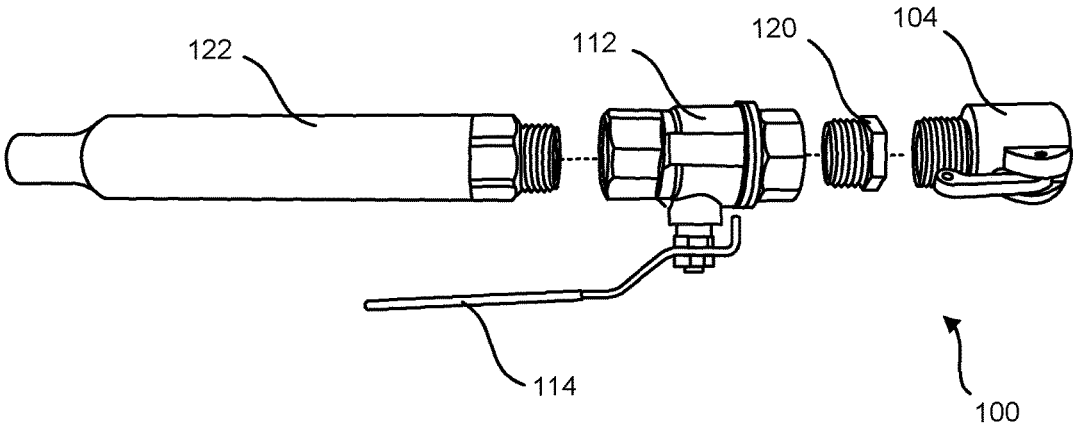
FIG. 3 illustrates an exploded view of the launching device in accordance with an embodiment of the present invention.

FIG. 3 illustrates an exploded view of the launching device showing order of assembly of various parts of the device 100. a female quick disconnect member 104 connects to a ball valve 112, wherein distal end 110 of the female quick disconnect member 104 is connected to one end of the ball valve 112 via a male extrusion 120 and further a reservoir 122 has provision such as a threaded end that is configured to be connected to other end of the ball valve 112. Further the bottom end 126 of the reservoir 122 has provisions to connect a source of compressed gas (not shown) so as to allow the gas to flow into the reservoir 122 to store the compressed gas until the trigger 114 of the ball valve 112 is turned to open position, thereby allowing the compressed gas to escape from the reservoir 122 into the elongated hollow tube (not shown) to launch the loaded confetti (not shown) into the air. Several other ways to assemble the various parts of the device 100 can be done without departing from the scope and spirit of the invention.

In an exemplary embodiment, the launching system 100 for launching light weight articles 103 into air, comprising, an elongated hollow tube 102, wherein the elongated tube 102 comprising at least one light weight article 103; a ball valve 112 having one handle 114 which acts as a trigger wherein one end 116 of the ball valve 112 is connected to the elongated hollow tube 102; a reservoir 122, wherein top end 124 of the reservoir 122 is connected to other end 118 of the ball valve 112; and a source of compressed gas 132 which is connected to bottom end 126 of the reservoir 122, wherein the source 132 supplies compressed gas that is stored in the reservoir 122 until the trigger 114 of the ball valve 112 is turned to open position allowing the compressed gas to escape from the reservoir 122 into the elongated hollow tube 102, thereby launching the light weight articles 103 into the air.

In another exemplary embodiment, the launching system 100 for launching light weight articles 103 into air, comprising, an elongated hollow tube 102, wherein the elongated tube 102 comprising at least one light weight article 103; a ball valve 112 having one handle 114 which acts as a trigger wherein one end 116 of the ball valve 112 is connected to the elongated hollow tube 102; a source of compressed gas 132 which is connected to other end 118 of the ball valve 112, wherein the source 132 supplies compressed gas when the trigger of the ball valve 112 is turned to open position, thereby launching the light weight articles 103 into the air.

Figure 4:
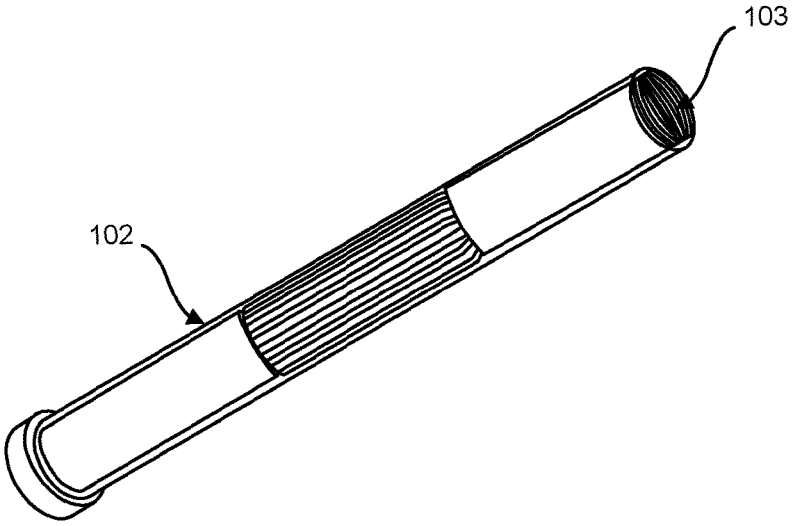
FIG. 4 illustrates a perspective view of an elongated hollow tube in accordance with an embodiment of the present invention.

FIG. 4 illustrates a perspective view of an elongated hollow tube in accordance with an embodiment of the present invention, wherein the elongated hollow tube loaded with one or more confetti 103, which is available in the market. For example the shorter tubes such as those in the order of 6 inches in length generally contain in the order of 3 to 4 stacks of confetti per tube while longer tubes such as those in the order of 12 to 18 inches in length generally contain in the order of 6 to 12 stacks or bundles of confetti per tube. Such tubes of constant diameter sold under the trademarks FLUTTER-FETTI. Further speed load tubes of confetti, double wrapped stacks of confetti and all sizes of streamers can be used by the launching device 100. The female quick disconnect member 104 (as shown in FIG. 1-3) has at least one cam lock lever at proximal end of the female quick disconnect member 104, so as to quickly connect and disconnect the elongated hollow tube 102. Several other available confetti loaded elongated hollow tubes 102 can be quickly fitted to the proximal end of the female quick disconnect member 104 without departing from the scope and spirit of the invention.

Figure 5:
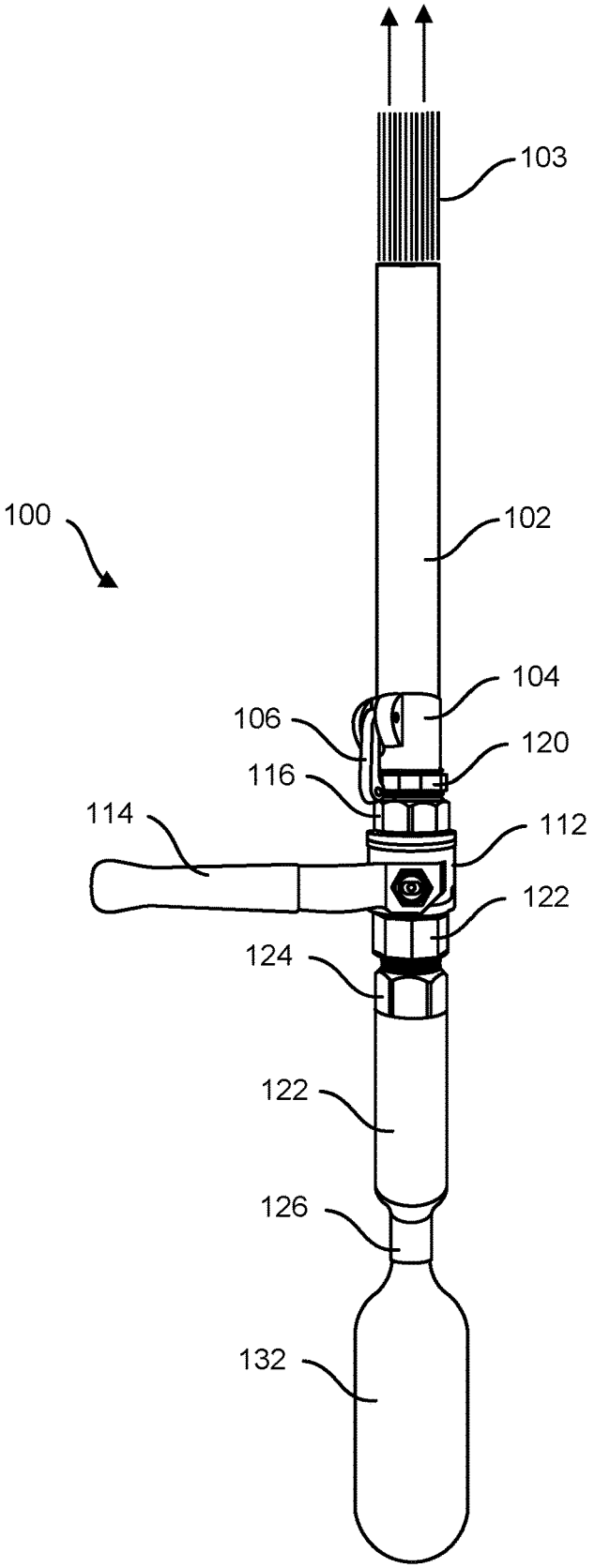
FIG. 5 illustrates a side view of an exemplary confetti launching device having trigger turned to firing position in accordance with an embodiment of the present invention.

FIG. 5 illustrates a side view of an exemplary confetti launching device 100 having trigger 114 turned off to closed (non-firing) position. As shown in the figure a compressed CO2 gas cartridge 132 connected to the bottom end of the reservoir 122 so as to allow the gas to flow into the reservoir 122 to store the compressed gas until the trigger 114 of the ball valve 112 is turned to open position. The ball valve 112 having a pivoting ball with a hole (not shown), thereby allowing flow of compressed gas from the reservoir 122 when the hole is in line with the flow and closed when the ball is pivoted by turning the handle of the ball valve through 90 degrees, thus the handle 114 lies flat in alignment with the flow when open, and is perpendicular to it when close assisting easy visual confirmation of the valve's status. When the ball valve 112 is in open position, allowing the compressed gas to escape from the reservoir 122 into the elongated hollow tube 102 to launch the loaded confetti 103 into the air.

In accordance with one aspect of the present invention, a confetti launching system 100 for launching confetti 103 into air, comprising an elongated hollow tube 102, wherein the elongated tube 102 comprising at least one confetti 103; a female quick disconnect member 104 having at least one cam lock lever 106 at proximal end 108 of the female quick disconnect member 104, so as to quickly connect and disconnect the elongated hollow tube 102; a ball valve 112, which is a ¾ inch manually turned quarter-turn valve having one handle 114 which acts as a trigger, wherein distal end 110 of the female quick disconnect member 104 is connected to one end 116 of the ball valve 112 via a threaded male extrusion 120; a reservoir 122, which is a long aluminum pipe having ¾ inch threaded top end 124 is connected to other end 118 of the ball valve 112, wherein the bottom end 126 of the reservoir 122 is tapered to ⅝ of an inch outer diameter with a ⅜ inch inside thread; and a compressed CO2 gas cartridge 132 which is screwed to the inside thread of the reservoir 122 at the bottom end 126, wherein a central hollow steel shaft 128 at the bottom end 126 of the reservoir 122 pierce the cartridge 132 when screwed tightly and a rubber O ring 130 at the bottom end 126 of the reservoir 122 to make an airtight seal, thereby allowing the gas to flow into the reservoir 122 and is stored there until the trigger 114 of the ball valve 112 is turned to open position allowing the compressed gas to escape from the reservoir into the elongated hollow tube 102, thereby launching the confetti 103 into the air.

It is another aspect of the present invention is to provide a method for launching confetti 103 into air, comprising, loading an elongated hollow tube 102 with at least one confetti 103; connecting a female quick disconnect member 104 having at least one cam lock lever 106 at proximal end 108 to one end of the elongated hollow tube 102, wherein the cam lock lever 106 facilitates in quick connection and disconnection of the elongated hollow tube 102; connecting one end 116 of a ball valve 112 to distal end 110 of the female quick disconnect member 104 via a threaded male extrusion 120, wherein the ball valve 112 is a ¾ inch manually turned quarter-turn valve having one handle 114 which acts as a trigger for launching the confetti 103; connecting a long aluminum pipe having ¾ inch threaded top end 124 to other end 118 of the ball valve 112, wherein the bottom end 126 of the aluminum pipe 122 is tapered to ⅝ of an inch outer diameter with a ⅜ inch inside thread; and connecting a compressed CO2 gas cartridge 132 to the inside thread of the aluminum pipe 122 at the bottom end 126, wherein a central hollow steel shaft 128 at the bottom end 126 of the aluminum pipe 122 pierce the cartridge 132 when screwed tightly and a rubber O ring 130 at the bottom end 126 of the aluminum pipe 122 to make an airtight seal, thus allowing the gas to flow into the aluminum pipe 122 which acts as a reservoir to store the compressed gas until the trigger 114 of the ball valve 112 is turned to open position, thereby allowing the compressed gas to escape from the reservoir 122 into the elongated hollow tube 102 to launch the loaded confetti 103 into the air.

In another aspect, the light weight articles 103 comprise stacks of confetti.

In another aspect, lifting the cam lock lever 106 of the female quick disconnect member 104 quickly releases the elongated hollow tube 102.

In another aspect, the outer diameter of the elongated hollow tube 102 provides a snug fit with the inner wall surface of the female quick disconnect member 104 at the proximal end 106, further, the cam lock lever 106 in closed position provides additional secured connection of the elongated hollow tube 102.

In another aspect, the ball valve 112 is a ¾ inch manually turned quarter-turn valve having a pivoting ball with a hole, thereby allowing flow of compressed gas when the hole is in line with the flow and closed when the ball is pivoted by turning the handle 114 of the ball valve through 90 degrees. Other various sizes of ball valve 112 can be used without departing from the scope and spirit of the invention In another aspect, the male extrusion 120 is a treaded male extrusion.

In another aspect, the reservoir 122 is a cylindrical aluminum pipe having length ranging between 4 to 8 inch. However other various material composition and sizes of reservoir 122 can be used without departing from the scope and spirit of the invention.

In another aspect, the top end 124 of the reservoir 122 is ¾ inch threaded and bottom end 126 is tapered to ⅝ of an inch outer diameter with a ⅜ inch inside thread. However other various shapes of reservoir 122 can be used without departing from the scope and spirit of the invention.

In another aspect, the source of compressed gas 132 is a compressed gas cartridge such as CO2 cartridge or the like which is screwed to the inside thread of the reservoir 122 at the bottom end 126, wherein a hollow piercing means 128 at the bottom end 126 pierce the cartridge 132 when screwed tightly, thereby allowing the gas to flow into the reservoir 122. Several other type of compressed gas cartridges can be used without departing from the scope and spirit of the invention.

In another aspect, the CO2 cartridge 132 seats against a rubber O ring 130 at the bottom end 126 of the reservoir 122 to make an airtight seal. However other types of sealing member 130 can be used without departing from the scope and spirit of the invention.

In another aspect, the compressed CO2 gas cartridge 132 is a 16 gram Co2 cylinder. However other various sizes of cartridge or other type of compressed gas source 132 can be used without departing from the scope and spirit of the invention.

In another aspect, the ball valve 112 having a pivoting ball with a hole, thereby allowing flow of compressed gas when the hole is in line with the flow and closed when the ball is pivoted by turning the handle 114 of the ball valve 112 through 90 degrees, thus the handle 114 lies flat in alignment with the flow when open, and is perpendicular to it when close assisting easy visual confirmation of the valve's status.

One objective of the present invention is to provide a safe and easy to operate confetti launching system 100.

Another objective is to enable the device 100 to provide multiple shots of confetti from the cannon with a single cartridge, however the device can be used as a single shot trigger with a smaller size cartridge.

Yet another objective is to provide easy and quick loading and unloading of the elongated hollow tube 102 to the launching device 100 by operating the cam lock lever 106 of the female quick disconnect member 104.

Yet another objective is to provide an easy to manually shoot confetti in a controlled manner and easy visual confirmation of status of the trigger 114 of the launching device 100.

Yet another objective is to provide a launching device 100 which requires no skill and training to quickly attach and detach the cannons or the elongated hollow tubes 102 from the device 100.

Yet another objective is to provide launching device 100 which is capable of firing plurality of confetti 103 into the air in a controlled manner for displaying a predetermined visual effect of the cloud of confetti.

These and other advantages of the invention will be further understood and appreciated by those skilled in the art by reference to the following written specification, claims and appended drawings.

The invention may also be described in the following numbered paragraphs:

1. A launching system for launching light weight articles into air, comprising:

an elongated hollow tube, wherein the elongated tube comprising at least one light weight article;

a ball valve having one handle which acts as a trigger wherein one end of the ball valve is connected to the elongated hollow tube;

a reservoir, wherein top end of the reservoir is connected to other end of the ball valve; and a source of compressed gas which is connected to bottom end of the reservoir, wherein the source supplies compressed gas that is stored in the reservoir until the trigger of the ball valve is turned to open position allowing the compressed gas to escape from the reservoir into the elongated hollow tube, thereby launching the light weight articles into the air.

2. The launching system of paragraph 1, wherein the ball valve having a pivoting ball with a hole, thereby allowing flow of compressed gas when the hole is in line with the flow and closed when the ball is pivoted by turning the handle of the ball valve through 90 degrees, thus the handle lies flat in alignment with the flow when open, and is perpendicular to it when close assisting easy visual confirmation of the valve's status.

3. A launching system for launching light weight articles into air, comprising:

an elongated hollow tube, wherein the elongated tube comprising at least one light weight article;

a ball valve having one handle which acts as a trigger wherein one end of the ball valve is connected to the elongated hollow tube;

a source of compressed gas which is connected to other end of the ball valve, wherein the source supplies compressed gas when the trigger of the ball valve is turned to open position, thereby launching the light weight articles into the air.

4. The launching system of paragraph 3, wherein the ball valve having a pivoting ball with a hole, thereby allowing flow of compressed gas when the hole is in line with the flow and closed when the ball is pivoted by turning the handle of the ball valve through 90 degrees, thus the handle lies flat in alignment with the flow when open, and is perpendicular to it when close assisting easy visual confirmation of the valve's status.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A launching system for launching light weight articles into air, comprising:

an elongated hollow tube, wherein the elongated tube comprising at least one light weight article;

a female quick disconnect member having at least one cam lock lever at proximal end of the female quick disconnect member, so as to quickly connect and disconnect the elongated hollow tube;

a ball valve having one handle which acts as a trigger, wherein distal end of the female quick disconnect member is connected to one end of the ball valve via a male extrusion;

a reservoir, wherein top end of the reservoir is connected to other end of the ball valve; and a source of compressed gas which is connected to bottom end of the reservoir, wherein the source supplies compressed gas that is stored in the reservoir until the trigger of the ball valve is turned to open position allowing the compressed gas to escape from the reservoir into the elongated hollow tube, thereby launching the light weight articles into the air; and wherein the reservoir is a cylindrical aluminum pipe having length ranging between 4 to 8 inch.

2. The launching system of claim 1, wherein the top end of the reservoir is ¾ inch threaded and bottom end is tapered to ⅝ of an inch outer diameter with a ⅜ inch inside thread.

3. A confetti launching system for launching confetti into air, comprising:

an elongated hollow tube, wherein the elongated tube comprising at least one confetti;

a female quick disconnect member having at least one cam lock lever at a proximal end of the female quick disconnect member, so as to quickly connect and disconnect the elongated hollow tube;

a ball valve, which is a ¾ inch manually turned quarter-turn valve having one handle which acts as a trigger, wherein a distal end of the female quick disconnect member is connected to one end of the ball valve via a threaded male extrusion;

a reservoir, which is a long aluminum pipe having ¾ inch threaded top end is connected to another end of the ball valve, wherein a bottom end of the reservoir is tapered to ⅝ of an inch outer diameter with an ⅜ inch inside thread of ⅜ of an inch; and a compressed $CO_2$ gas cartridge or the like which is screwed to the inside thread of the reservoir at the bottom end, wherein a central hollow steel shaft at the bottom end of the reservoir pierce the cartridge when screwed tightly and a rubber O ring at the bottom end of the reservoir to make an airtight seal, thereby allowing the compressed $CO_2$ gas to flow into the reservoir and is stored there until the trigger of the ball valve is turned to open position allowing the compressed $CO_2$ gas to escape from the reservoir into the elongated hollow tube, thereby launching the confetti into the air.

4. The launching system of claim 3, wherein the compressed $CO_2$ gas cartridge is a 16 gram Co2 cylinder.

5. The launching system of claim 3, wherein the aluminum pipe is cylindrical in shape and having length ranging between 4 to 8 inch.

6. The launching system of claim 3, wherein the ball valve having a pivoting ball with a hole, thereby allowing flow of compressed gas when the hole is in line with the flow and closed when the ball is pivoted by turning the handle of the ball valve through 90 degrees, thus the handle lies flat in alignment with the flow when open, and is perpendicular to it when close assisting easy visual confirmation of the valve's status.

7. A method for launching confetti into air, comprising:

loading an elongated hollow tube with at least one confetti;

connecting a female quick disconnect member having at least one cam lock lever at a proximal end to one end of the elongated hollow tube, wherein the cam lock lever facilitates in quick connection and disconnection of the elongated hollow tube;

connecting one end of a ball valve to a distal end of the female quick disconnect member via a threaded male extrusion, wherein the ball valve is a ¾ inch manually turned quarter-turn valve having one handle which acts as a trigger for launching the confetti;

connecting a long aluminum pipe having ¾ inch threaded top end to other end of the ball valve, wherein a bottom end of the aluminum pipe is tapered to ⅝ of an inch outer diameter with an inch inside thread of ⅜ of an inch; and connecting a compressed $CO_2$ gas cartridge or the like to the inside thread of the aluminum pipe at the bottom end, wherein a central hollow steel shaft at the bottom end of the aluminum pipe pierce the cartridge when screwed tightly and a rubber O ring at the bottom end of the aluminum pipe to make an airtight seal, thus allowing the compressed $CO_2$ gas to flow into the aluminum pipe which acts as a reservoir to store the compressed gas until the trigger of the ball valve is turned to open position, thereby allowing the compressed $CO_2$ gas to escape from the reservoir into the elongated hollow tube to launch the loaded confetti into the air.

8. The method of claim 7, wherein the aluminum pipe is cylindrical in shape and having length ranging between 4 to 8 inch.

9. The method of claim 7, wherein the ball valve having a pivoting ball with a hole, thereby allowing flow of compressed gas when the hole is in line with the flow and closed when the ball is pivoted by turning the handle of the ball valve through 90 degrees, thus the handle lies flat in alignment with the flow when open, and is perpendicular to it when close assisting easy visual confirmation of status of the valve.

* * * * *